US005512406A

United States Patent [19]

Takeda et al.

[11] Patent Number: 5,512,406

[45] Date of Patent: Apr. 30, 1996

[54] TONERS OF DIFFERENT SIZE FOR ELECTROPHOTOGRAPHY

[75] Inventors: Kenichi Takeda; Tatsuya Tada, both of Yokohama; Nobuyuki Itoh, Oume; Masao Nakano, Kamakura; Kazuhisa Kemmochi, Yokohama; Isami Itoh, Kawasaki, all of Japan

[73] Assignee: Canon Kabushiki Kaisha, Tokyo, Japan

[21] Appl. No.: 321,903

[22] Filed: Oct. 12, 1994

[30] Foreign Application Priority Data

Oct. 14, 1993 [JP] Japan ..... 5-280332

[51] Int. Cl.[6] ..... G03G 9/097; G03G 9/08

[52] U.S. Cl. ..... 430/110; 430/111; 430/106.6

[58] Field of Search ..... 430/110, 111

[56] References Cited

U.S. PATENT DOCUMENTS

| | | | |
|---|---|---|---|
| 2,221,776 | 11/1940 | Carlson . | |
| 2,297,691 | 10/1942 | Carlson . | |
| 2,618,552 | 11/1952 | Wise . | |
| 2,874,063 | 2/1959 | Greig . | |
| 3,909,258 | 9/1975 | Kotz . | |
| 5,082,761 | 1/1992 | Tasaka et al. | 430/110 X |

FOREIGN PATENT DOCUMENTS

| | | | |
|---|---|---|---|
| 36-10231 | 7/1961 | Japan . | |
| 41-9475 | 6/1966 | Japan . | |
| 52256 | 3/1984 | Japan | 430/111 |
| 59-32375 | 8/1984 | Japan . | |
| 123857 | 7/1985 | Japan | 430/111 |
| 174772 | 7/1987 | Japan | 430/111 |

OTHER PUBLICATIONS

"Toner Mixture To Reduce Background Transfer effects", Xerox Discl. Jour., vol. 2, No. 5, Sep./Oct. 1977, p. 17.

*Primary Examiner*—Roland Martin

*Attorney, Agent, or Firm*—Fitzpatick, Cella, Harper & Scinto $

9 Claims, 4 Drawing Sheets

TONERS OF DIFFERENT SIZE FOR ELECTROPHOTOGRAPHY

BACKGROUND OF THE INVENTION

1. Field of the Invention

The present invention relates to a toner for electrophotography to be used in developing electrical or magnetic latent images in electrophotography, electrostatic printing, and the like.

2. Description of the Related Art

Toners for developing electrical or magnetic latent images, and the like are used in various processes for forming and recording images.

One of such image forming processes is electrophotography, a variety of which are available, as shown, for example, in U.S. Pat. No. 2,297,691.

In electrophotography, which uses a photosensitive member generally formed of a photoconductive material, an electrical latent image is formed on the photosensitive member by various means. The electrical latent image is developed by using a toner. The toner image thus obtained is transferred to a recording material, such as paper, and then fixed thereto by heating or pressurization or by using solvent vapor or the like, thereby obtaining a copy of the image. Where a process for transferring toner images to recording material is included, there is usually also provided a process for removing the toner remaining on the photosensitive member.

The following are examples of developers conventionally used in dry development devices for electrophotography:

1: One-component-type magnetic developer comprising a toner containing magnetic powder.

2: One-component-type non-magnetic developer comprising a toner containing no magnetic powder.

3: Two-component-type non-magnetic developer comprising a toner containing no magnetic powder and a magnetic carrier, which is mixed with the toner in a fixed proportion.

4: Two-component-type magnetic developer comprising a toner containing magnetic powder and a magnetic carrier, which is mixed with the toner in a fixed proportion.

Various development methods using such toners have been proposed and put into practical use. Examples of such development methods include: the magnetic brush method described in U.S. Pat. No. 2,874,063; the cascade development described in U.S. Pat. No. 2,618,552; the powder cloud development described in U.S. Pat. No. 2,221,776; the method using conductive magnetic toner described in U.S. Pat. No. 3,909,258; and the method using various insulating magnetic toners disclosed in Japanese Patent Publication No. 41-9475.

The toners used in these development methods are generally manufactured by a pulverizing method in which a coloring agent like a dye or pigment is mixed with, and uniformly dispersed in, a thermoplastic resin serving as the binder. The mixed substance thus obtained is then finely pulverized and classified so as to provide a desired particle size.

The above manufacturing process, which can produce very excellent toners, has a problem in that there is a certain limitation regarding the range of choices for the toner materials.

For example, the above-mentioned mixed substance, which comprises the binder resin and the coloring agent, and the like uniformly dispersed therein, must be brittle enough to be finely pulverized by a manufacturing apparatus which allows economical use.

As a result, when it is finely pulverized at high speed in an actual manufacturing process, a particle group having a wide range of particle size can be formed, resulting in a so-called broadening of particle size distribution. In particular, the resulting pulverized product contains a relatively large proportion of particle groups which have undergone excessive fine pulverizing. Moreover, when actually used as a developer in copying machines, and the like, such a highly brittle toner is liable to undergo further fine pulverization or powdering.

Japanese Patent Publication No. 36-10231 discloses a toner manufacturing process based on suspension polymerization as a means for overcoming the above problem in the pulverizing method, i.e., the broadening of toner particle size distribution.

According to this process, a polymerizing monomer and a coloring agent, together with a polymerization initiator, cross linking agent, charge control agent, and other additives, as needed, are uniformly dissolved or dispersed to provide a monomer composition. The monomer composition is dispersed in a continuous phase (e.g., water phase) containing a dispersion stabilizer by using an appropriate agitator, and, at the same time, polymerization is effected, whereby toner particles having a desired particle size can be obtained. However, a toner for copying machines which was actually manufactured by the above process still needs improvement in terms of sharpness in particle size distribution, although the broadening of particle size distribution had been mitigated as compared with that in the pulverizing method.

Other toner manufacturing processes based on polymerization, for example, emulsion polymerization, precipitation polymerization, dispersion polymerization, soap-free emulsion polymerization and seed polymerization, also provide improvements in terms of broadening of toner particle size distribution. However, in these processes, the toner particles produced are fine spherical particles, so that, when toner images are transferred to the recording material, it is usually difficult to remove the remaining toner on the photosensitive member. Thus, these methods need further improvement.

One of the problems attributable to broadening of toner particle size distribution is that the way the toner flies from the developer carrier to the photosensitive drum differs depending on the particle size of the toner particles.

This will be explained with reference to FIG. 2, which shows the particle size distribution of the toner particles of an ordinary one-component-type magnetic developer prepared by the above-described pulverizing method. Toner tribo electric charge measurement was performed at three points in FIG. 2: point Y indicating the number average particle size (approximately 7 μm); point X indicating a particle size smaller than the average (approximately 3.5 μm); and point Z indicating a particle size larger than the average (approximately 10 μm). The measurement results are shown in Table 1.

TABLE 1

| Toner Triboelectric | | | |
|---|---|---|---|
| Results Obtained At Three Different Toner Particle Sizes | | | |
| Toner particle size (μm) | 3.5 | 7 | 10 |
| Toner tribo electric charge (μc/g) | 40 | 10 | 6 |

The results shown in Table 1 indicate the conventionally known fact that toner triboelectric charge is substantially in proportion to toner surface area (which is the reciprocal of the square of toner particle size). The way toner transfers (i.e., its developing capacity) greatly depends on the toner configuration. For example, as shown in FIG. 3, the particle size of transferable toner varies with the development contrast (i.e., the difference in potential between the latent image on the developer carrier holding toner and that on the photosensitive member). It can be seen from FIG. 3 that, the lower the development contrast, the smaller the particle size of the transferring toner.

FIG. 3 shows experimental results obtained by using the copying machine NP 6650 (manufactured by Canon K. K.). In the experiment, sampling was performed on the toner transferring onto the photosensitive member on which latent images were formed with different development contrasts (0 V, 200 V, and 400 V), and the particle size distribution of the toner was measured by a Coulter Counter.

In the above experiment, a so-called non-contact development method or jumping development method, described, for example, in Japanese Patent Publication No. 59-32375, was employed, in which, as shown in FIG. 4, an alternating electric field with superimposed DC voltage is applied between a photosensitive drum 1 and a development sleeve 3.

More specifically, by using this electric field, toner was caused to transfer from the development sleeve 3 to the photosensitive drum 1 over the gap therebetween, which was 250 μm or less. A latent image with dark portions of +600 V and bright portions of 0 V was formed on the photosensitive drum 1, and a development bias voltage comprising a rectangular-wave alternating voltage of a peak-to-peak voltage of 1400 V and a frequency of 1800 Hz, and a DC voltage of +150 V, superimposed thereon, was applied to the development sleeve 3.

While in the above method an alternating electric field is superimposed as the development bias, various phenomena attributable to differences in toner particle sizes, as in the above case, are also generated in an apparatus of the type in which the development bias applied consists of a DC voltage only.

Various development devices have been proposed or put into practical uses which do not depend upon differences in toner particle size, and in which it is possible, for example, to impart triboelectric charge in a uniform manner. At present, however, no apparatus is available in which the above problem has been overcome.

Further, it is possible to effect toner triboelectric charge control by means of an additive such as silica. However, the amount of the additive in the toner is determined by the average condition of the particle size distribution of that toner, so that it is difficult to add a proper amount of additive to the toner particles composing particle size distributions.

That is, the additive is uniformly added to the entire toner, which has a broad particle size distribution. In other words, the amount of additive is not controlled by adding a relatively large amount of additive to a toner portion having a smaller particle size (a larger specific surface area) and adding a relatively small amount of additive to a toner portion having a larger particle size (a smaller specific surface area). Thus, the broader the toner particle size distribution, the less likely the toner at the ends of the particle size distribution can have the proper amount of additive.

Therefore, the difference in toner particle size between the transferring toner particles due to the variation in development contrast causes a change in the particle size distribution of the remaining toner in the developer unit after the formation of a large number of images. That is, the proper, initially set development conditions, e.g., the proper development-bias condition, are departed therefrom, resulting in a deterioration in image quality, such as a reduction in image density or fogging in non-image portions.

Further, the following problem has to be taken into account where there is a process for transferring toner images, in which a process for removing the toner remaining on the photosensitive member is usually provided: in a photosensitive-member-surface cleaning means, such as blade cleaning, it is generally difficult to remove a toner portion having a smaller particle size. This is attributable to the fact that a toner having a small particle size can pass through the interface between the photosensitive member and the blade and that, in the case of a toner having a small particle size, the adhesive force with respect to the photosensitive member, such as reflection force, is relatively large due to the higher toner triboelectric charge.

The extra toner thus allowed to remain on the photosensitive member leads to contamination of the interior of the development device, and, further, shortens the life of the cleaning blade serving as the photosensitive member cleaning means.

The toner produced by the above-described methods, based on suspension polymerization, and the like, is in the form of fine spherical particles, which means it is even easier for them to pass through the interface between the photosensitive member and the blade.

Therefore, an appropriate amount of auxiliary cleaning agent is often added when a toner is produced so that the removal of the toner having a smaller particle size from the photosensitive member may be promoted. However, like adding an additive, an amount of auxiliary cleaning agent proper for a toner portion having a smaller particle size can be excessive for a toner portion having a larger particle size and, consequently, a smaller specific surface area. As a result, the toner portion having the larger particle size is subject to a change in charging characteristics due to surface contamination. Further, the method involves device contamination due to scattering of toner, fogging in non-image portions, and the like.

SUMMARY OF THE INVENTION

It is accordingly an object of the present invention to provide a toner for electrophotography in which the above problems have been solved.

That is, it is an object of the present invention to provide a toner for electrophotography in which the difference in development conditions between different particle sizes due to broadening of toner particle size distribution is minimized and which can provide a stable image quality that is free from fogging in non-image portions for an extended period of time.

Another object of the present invention is to provide a toner for electrophotography which remains free from contamination of the exterior and interior of the device for a long period of time.

According to a first aspect of the present invention, a toner for electrophotography comprising:

a first toner A comprising a toner particle group (a) having a first particle size distribution and an additive; and a second toner B comprising a toner particle group (b) having a second particle size distribution different from the first particle size distribution and an additive;

wherein the toner particle group (a) has a smaller average particle size than that of the toner particle group (b) and the amount of additive in the first toner A is greater than the amount of additive in the second toner B.

According to a second aspect of the present invention, a process for making a toner for electrophotography comprising the steps of:

adding an additive to a toner particle group (a) having a first particle size distribution to form a first toner A;

adding an additive to a toner particle group (b) having a second particle size distribution different from the first particle size distribution to form a second toner B; and mixing the first toner A with the second toner B;

wherein the toner particle group (a) has a smaller average particle size than that of the toner particle group (b) and the amount of additive added to the first toner A is greater than the amount of additive added to the second toner B.

DETAILED DESCRIPTION OF THE PREFERRED EMBODIMENTS

Figure 1:
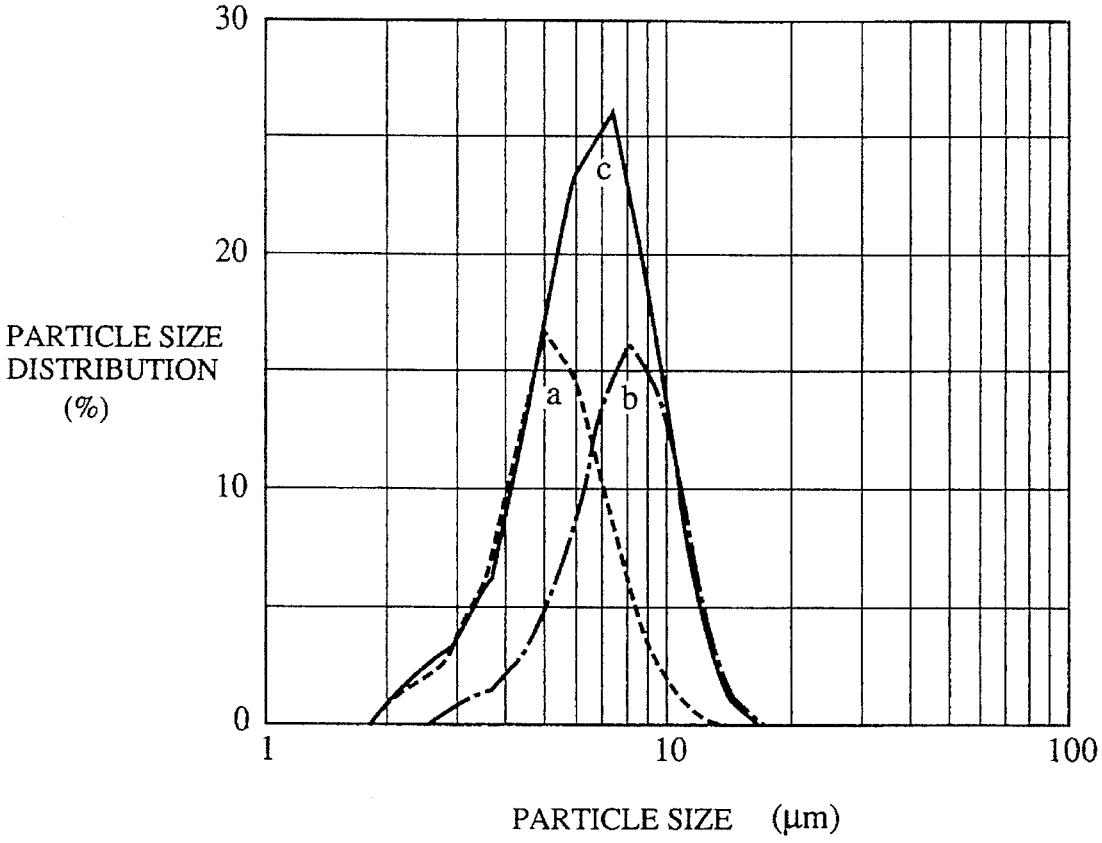
FIG. 1 is a diagram showing the number average particle size distribution during manufacture of a toner according to an embodiment of the present invention.
Figure 2:
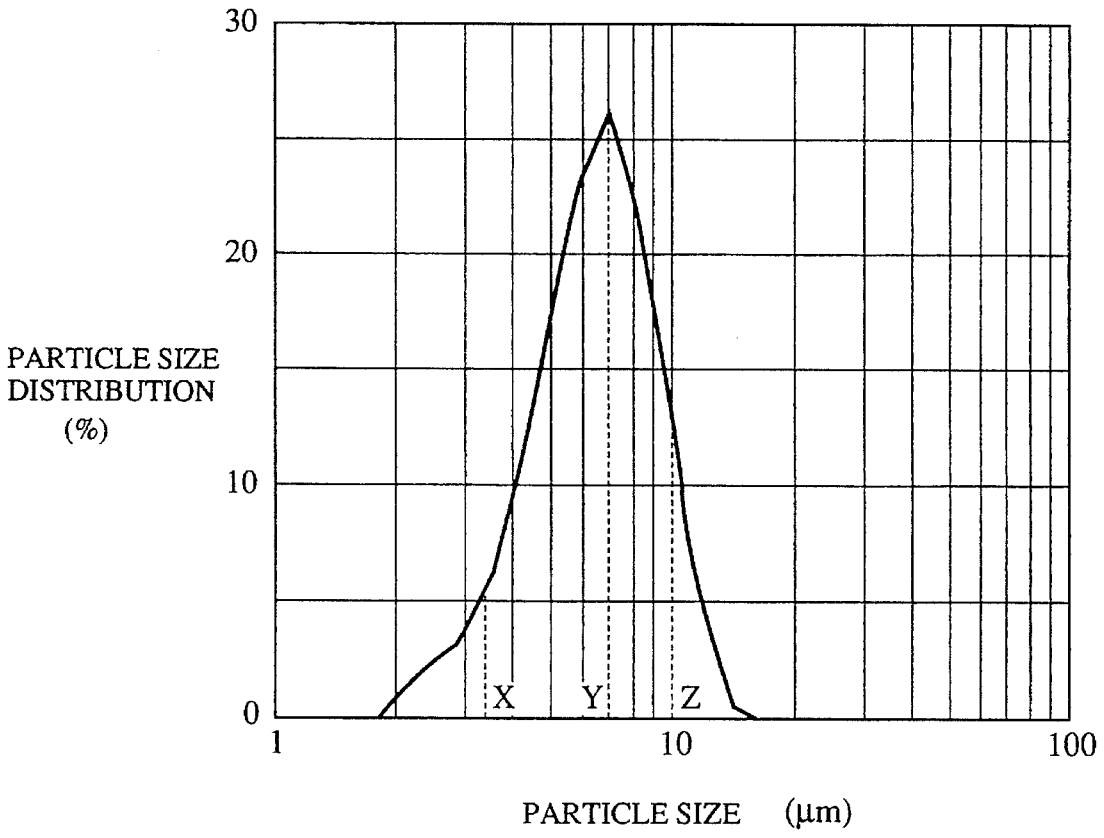
FIG. 2 PRIOR ART
FIG. 2 is a diagram showing the number average particle size distribution of a conventional toner.
Figure 3:
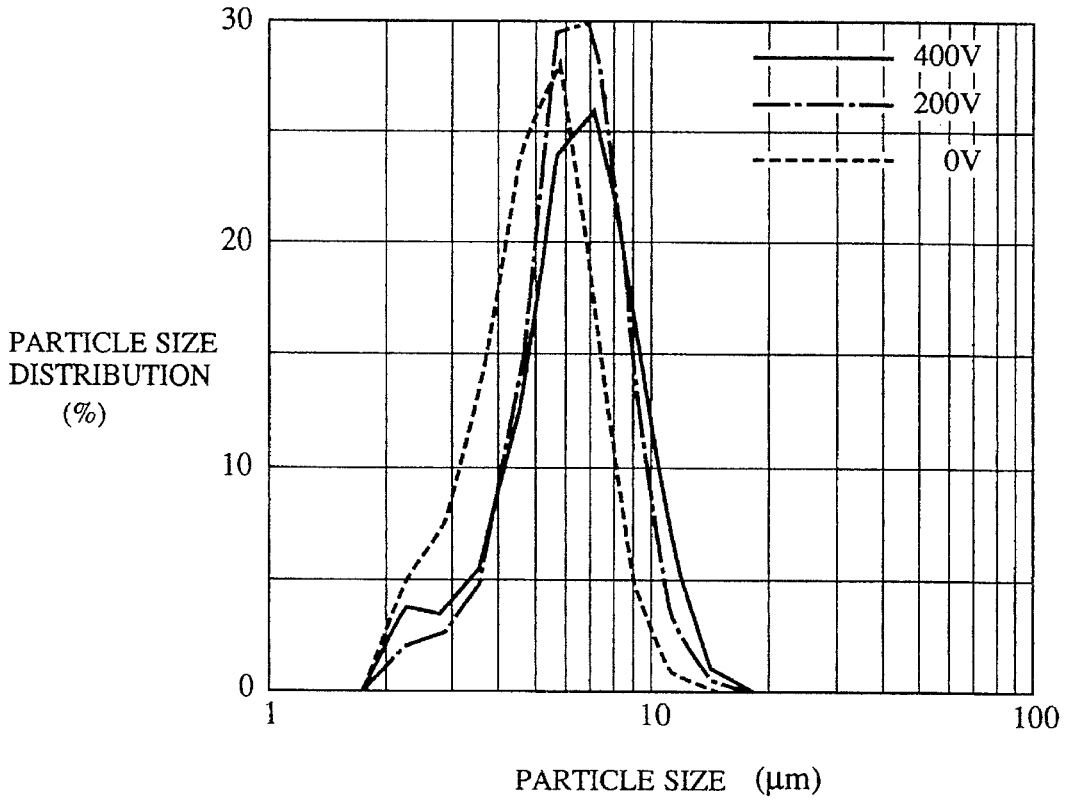
FIG. 3 PRIOR ART
FIG. 3 is a diagram showing the relationship between development contrast and the particle size distribution of toner transferring onto a photosensitive member in the case of a conventional toner.

The present inventors carefully examined the relationship between a toner particle group having a particle size distribution and the amount of additive added to this toner particle group, and found that in a toner obtained by mixing a first toner particle group having a smaller average particle size (a larger specific surface area) with a second toner particle group having a larger average particle size (a smaller specific surface area) after adding a relatively large amount of additive to the first toner particle group and a relatively small amount of additive to the second toner particle group, the toner portions at both ends of the particle size distribution include a smaller amount of toner particles than those obtained in the prior art which contain an excessive or insufficient amount of additive. As a result, the present invention can maintain the proper, initially set development conditions even after a durability test to form a large number of images.

The toner of the present invention is obtained by mixing toners A and B together, which are obtained by respectively adding an additive to each of at least two toner particle groups (a) and (b) having different particle size distributions.

The average particle size of the toner particle group (a) is smaller than the average particle size of the toner particle group (b), and it is desirable that the amount of additive added to the toner particle group (a), which has a smaller average particle size, be larger than that added to the toner particle b, which has a larger average particle size.

That is, the content of additive in the toner A, comprising the mixture of the toner particle group (a) and the additive, is larger than the content of additive in the toner B, comprising the mixture of the toner particle group (b) and the additive.

Thus, in the toner of the present invention, the amount of additive added to the toner particle group (a), having a larger specific surface area, is relatively large, and the amount of additive added to the toner particle group (b), having a smaller specific surface area, is relatively small, whereby it is possible to mitigate the difference in development conditions between different particle sizes due to broadening of toner particle size distribution.

If, when obtaining a toner by mixing the toners A and B with each other, the amount of additive in the toner A and the amount of additive in the toner B are the same, or if the amount of additive in the toner A is smaller than the amount of additive in the toner B, development capacity can deteriorate.

In the present invention, the above-mentioned at least two toner particle groups (a) and (b) having different particle size distributions can be obtained by: (i) obtaining a toner particle group having a specific particle size distribution through classification and then dividing the thus obtained toner particle group through re-classification to thereby obtain a toner particle group (a) having a smaller average particle size and a toner particle group (b) having a larger average particle size; or (ii) separately preparing a toner particle group having a smaller average particle size and a toner particle group having a larger average particle size.

In the present invention, the number average particle size of the toner preferably ranges from 2 to 12 μm, more preferably, from 3 to 9 μm, from the viewpoint of image quality.

To prepare a toner having such an average particle size, it is desirable for the number average particle size of the toner particle group (a), having the smaller average particle size, to range from 2 to 8 μm, more preferably, from 3 to 7 μm, and, for the number average particle size of the toner particle group (b), having the larger number average particle size, to range from 5 to 12 μm, more preferably, from 6 to 9 μm.

When the number average particle size of the toner particle group (a) is in excess of 8 μm, the amount of additive is excessive, with the result that the interior of the developer unit is subject to scattering of toner, which leads to contamination of the interior of the developer unit, fogging in images, and the like. When the number average particle size of the toner particle group (a) is less than 2 μm, development efficiency can deteriorate.

When the number average particle size of the toner particle group (b) is in excess of 12 μm, the amount of additive is excessive, with the result that the interior of the developer unit is subject to scattering of toner, which leads to contamination of the interior of the developer unit, image fogging, and the like. When the number average particle size of the toner particle group (b) is less than 5 μm, development efficiency can deteriorate.

The toner of the present invention contains a binder resin such as a thermoplastic resin, and a coloring agent such as a dye or pigment, and, further, a charge control agent, releasing agent, magnetic powder, and other additives as needed. These components will be separately described.

Examples of the binder resin used in the present invention include: homopolymers of styrene and substitution products thereof, such as polystyrene, poly-p-chlorostyrene, and polyvinyl toluene; styrene-type copolymers, such as styrene-p-chlorostyrene copolymer, styrene-vinyltoluene copolymer, styrene-vinylnaphthalene copolymer, styrene-methyl-acrylate copolymer, styrene-ethyl-acrylate copolymer, styrene-butyl-acrylate copolymer, styrene-acryl-2-ethyl-hexyl copolymer, styrene-octyl-acrylate copolymer, styrene-methyl-methacrylate copolymer, styrene-ethyl-methacrylate copolymer, styrene-butyl-methacrylate copolymer, styrene-α- methyl-chloromethacrylate copolymer, styrene-acrylonitrile copolymer, styrene-vinyl-methyl-ether copolymer, styrene-vinyl-methyl-ketone copolymer, styrene-butadiene copolymer, styrene-isoprene copolymer, styrene-acrylonitrile-indene copolymer, styrene-maleic-acid copolymer, and styrene-maleate copolymer; polymethyl methacrylate; polybutyl methacrylate; polyvinyl chloride, polyvinyl acetate; polyethylene; polypropylene; polyester; polyurethane; polyamide; epoxy resin; polyvinyl butyral; polyacrylic resin; rosin; denatured rosin; terpene resin; phenol resin; aliphatic or alicyclic hydrocarbon resin; aromatic-type petroleum resin; chlorinated paraffin; and paraffin wax. These may be used either singly or as a mixture.

The coloring agent used in the present invention may be any well-known coloring agent. More specifically, examples of the coloring agent include: dyes and pigments, such as carbon black, iron black, graphite, nigrosine, metallic complex of monoazo dye, ultramarine, copper phthalocyanine, methylene blue, chrome yellow, quinoline yellow, hanza yellow, benzene yellow, Du Pont Oil Red, and various types of quinacridone lake pigments.

When the coloring agent is contained in a non-magnetic toner, it is desirable for its amount to be approximately 2 to 30 wt % with respect to 100 wt % of the non-magnetic toner. When the coloring agent is contained in a magnetic toner, it is desirable for its amount to be approximately 0.5 to 15 wt % with respect to 100 wt % of the non-magnetic toner.

The charge control agent is added as needed to control the charging polarity and charge amount of the toner. In the present invention, any well-known appropriate charge control agent may be selected in accordance with the polarity and charge amount of the toner. Specific examples of the charge control agent include but not limited to metallic-complex-salt-azo-type dyes and nigrosine-type dyes.

When the charge control agent is contained in a non-magnetic toner, it is desirable for its amount to be approximately 0.2 to 10 wt % with respect to 100 wt % of the non-magnetic toner. When the charge control agent is contained in a magnetic toner, it is desirable for its amount to be approximately 0.2 to 10 wt % with respect to 100 wt % of the magnetic toner.

Wax is added as needed as a releasing agent for fixation or for preventing offset. In the present invention, various well-known waxes may be employed, such as polyethylene wax, polypropylene wax, and silicone wax, in accordance with the requisite properties.

When the wax is contained in a non-magnetic toner, it is desirable for its amount to be approximately 2 to 40 wt %, more preferably, approximately 2 to 10 wt %, with respect to 100 wt % of the binder resin. When the wax is contained in a magnetic toner, it is desirable for its amount to be approximately 0.5 to 40 wt %, more preferably, approximately 0.5 to 10 wt % with respect to 100 wt % of the binder resin The toner of the present invention is produced, for example, as follows:

First, the requisite materials are selected from the above-mentioned additives, i.e., coloring agents, charge control agents, waxes, magnetic powder, and the like. Predetermined amounts of these materials are mixed with binder resin, melted, kneaded and cooled before being roughly pulverized by a pulverizer like a hammer mill or cutter mill. Then, after being finely pulverized by a pulverizer like a jet mill or ang mill, the mixture is classified to obtain a desired volume average particle size or number average particle size.

Subsequently, as shown in FIG. 1, the thus obtained classified product (c) exhibiting an average particle size, for example, of approximately 7 μm, is further classified into a toner particle group (a) exhibiting an average particle size of approximately 5 μm (which is on the smaller-particle-size side) and a toner particle group (b) exhibiting an average particle size of approximately 8 μm (which is on the larger-particle-size side).

Various functional additives, such as fluidity improving agents, lubricants, abrasives, conductivity imparting agents, and fixation assistants, are added as needed to the toner particle groups (a) and (b) obtained as described above, and the mixtures are agitated, thereby preparing the toners A and B containing the toner particle groups (a) and (b), respectively. The amount of additive in the toner A, having the toner particle group (a) with a smaller particle size (a larger specific surface area), is larger than the amount of additive in the toner B, having the toner particle group (b) with a larger particle size (a smaller specific surface area).

The toners A and B, thus containing different amounts of additives, are then mixed with each other in an appropriate proportion, and agitated together, whereby a toner according to the present invention is obtained.

The proper amounts of additive in the toners, which vary depending upon the conditions of the actually used development device, and the like, may be determined by a specific-surface-area ratio obtained through spherical approximation using the respective average particle sizes of the toners.

In the present invention, the mixing of the toner particle groups with the additive, and the mixing together of the toners A and B, each containing the additive, can be effected by using a mixing means, such as a Henschel mixer, ball mill, or coffee mill.

The load applied when the toners A and B, each containing additives, are mixed together in the mixing means should be smaller than the load applied when the toner particle groups are mixed with the additive in the mixing means. This enables the respective proper amounts of additive for the toners A and B to be maintained after the toners A and B are mixed.

Examples of the additive used in the present invention include: silica, titanium oxide, resin powders as mentioned above as toner binders, polytetrafluoroethylene powder, polyvinylidene fluoride powder, molybdenum disulfide, tungsten disulfide, boron nitride, tin oxide, antimony oxide, strontium sulfate, aluminum sulfate, calcium carbonate, strontium titanate, cerium oxide, strontium oxide, metallic salts of higher fatty acids like zinc stearate, graphite, barium fluoride, calcium fluoride, carbon fluoride, carbon black or fine particles like conductive lead oxide. Some of these additives exhibit two or more of the above-mentioned functions.

In the present invention, it is possible to add two or more of the above-mentioned additives to at least one of the toners A and B.

The toner of the present invention, prepared in the manner described above, can be used as a one-component-type developer, or, as needed, mixed with carrier particles, such as iron powder, glass beads, nickel powder or ferrite powder, so as to be used as a two-component-type developer.

Further, when the toner is used as a one-component-type magnetic developer, a ferromagnetic element, or an alloy or compound which contains such ferromagnetic elements, is used as the magnetic powder. Specific examples of the magnetic powder include iron oxides, such as magnetite, hematite or ferrite, or alloys or compounds containing these iron oxides 5 and cobalt, nickel or manganese, and other well-known ferromagnetic alloys which can be used as magnetic powder.

The magnetic powder has an average particle size preferably ranging from 0.03 to 5 μm, more preferably, from 0.1 to 1 μm. Its content preferably ranges from 1 to 120 wt %, more preferably, from 20 to 80 wt %, with respect to 100 wt % of the toner.

Figure 4:
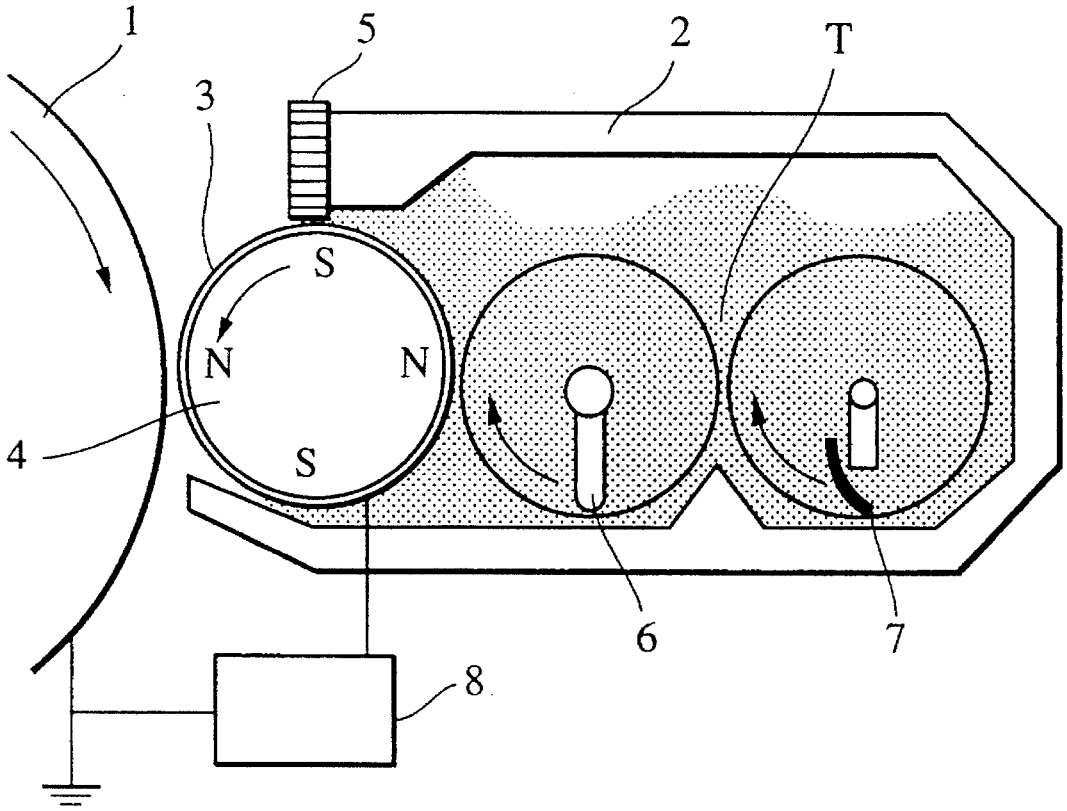
FIG. 4 is a schematic sectional view showing a development device used in the Examples of the present invention and in experiments of the description of the prior art.

FIG. 4 shows a development device to which the toner of the present invention is applicable.

In the drawing, numeral 1 indicates a photosensitive drum serving as the electrostatic latent image carrying member, and numeral 2 indicates a developer unit. The developer unit 2 contains toner T, which is fed to a development sleeve 3, containing a magnet roll 4 and serving as a toner carrier, by toner agitating means 6 and 7.

The development sleeve 3 is arranged so as to leave a fixed gap between it and the photosensitive drum 1. The toner supplied to the development sleeve 3 is uniformly applied the surface of the development sleeve 3. The thickness of the toner layer on the development sleeve 3 is controlled by a toner layer thickness control member 5 so as to be smaller than the gap between the development sleeve 3 and the photosensitive drum 1.

The toner layer formed on the development sleeve 3 is kept out of contact with the photosensitive drum 1. To effect development, a bias application means 8 applies an alternating voltage, which includes superimposed DC voltage, between the photosensitive drum 1 and the development sleeve 3, thereby causing the thin layer of toner on the development sleeve 3 to be transferred to the photosensitive drum 1.

The gap between the photosensitive drum 1 and the development sleeve 3 preferably ranges from 150 to 500 μm, and the thickness of the toner layer formed on the development sleeve 3 preferably ranges from 30 to 300 μm.

The development bias voltage is preferably provided by superimposing a DC voltage of 0 to 800 V on an alternating voltage of a peak-to-peak voltage of 800 to 3000 v and a frequency of 500 to 10000 Hz.

In the present invention, the particle size distribution of toner particles was measured by using the Coulter Counter Model TA-II (manufactured by Coulter Electronics Inc.) with an aperture of 100 μm, together with an interface (manufactured by Nikkaki K. K.) and CX-i personal computer (manufactured by Canon K. K.), which output number average and volume average particle size distributions. The electrolyte used was a 1% aqueous solution of NaCl prepared by using first class sodium chloride.

Specifically, the measurement was performed as follows: 0.1 to 5 ml of a surface active agent, preferably an alkyl benzene sulfonate, was added to 100 to 150 ml of this electrolyte as a dispersing agent, and, further, 0.5 to 50 mg of measurement specimen (toner) was added thereto. Then, the mixture was subjected to a dispersion process for approximately 1 to 3 minutes by using an ultrasonic disperser, thereby obtaining a dispersion liquid in which the specimen (toner) was uniformly suspended. By using the above-mentioned Coulter Counter MODEL TA-II, the particle size distribution of the toner particles of 2 to 40 μm in this measurement specimen was measured to obtain number average and volume average particle size distributions. Further, from these measurement results, the number average and volume average particle sizes of the toner was obtained In the present invention, the "average particle size" of a toner particle group means the number average particle size thereof, as is apparent from the examples described below.

The toner for electrophotography of the present invention comprises toner particles and an additive, wherein the toner is obtained by mixing together toners A and B obtained by respectively adding the additive to each of at least two toner particle groups (a) and (b) having different particle size distributions, and wherein the average particle size of the toner particle group (a) is smaller than that of the toner particle group (b), and the amount of additive in the toner A is larger than that in the toner B, whereby it is possible to minimize the difference in development conditions between different particle sizes due to broadening of toner particle size distribution, making it possible to obtain a stable image quality which is free from fogging in non-image portions for an extended period of time. Examples Next, the present invention will be described with reference to the following non-limiting examples.

EXAMPLE 1

The following materials were mixed together, and melted and kneaded at 160° C. in a roll mill.

| | |
|---|---|
| * styrene-2-ethylhexylacrylate-divinylbenzene copolymer | 100 parts by weight |
| * nigrosine | 5 parts by weight |
| * a magnetite having a BET specific surface area of 8 $m^2/g$ | 50 parts by weight |

The molten and kneaded substance thus obtained was cooled, and then roughly pulverized by a hammer mill. Further, it was finely pulverized by a jet pulverizer, and then classified by using an air classifier to obtain a black fine powder having a number average particle size of approximately 7 μm.

Next, the black fine powder thus obtained was fed again into the air classifier to be classified into a toner particle group $(a)_1$ having a number average particle size of approximately 5 μm and a toner particle group $(b)_1$ having a number average particle size of approximately 8 μm.

0.6 parts by weight of fine silicic acid powder (silica) was added to 100 parts by weight of the toner particle group $(a)_1$, and the mixture was agitated together in a Henschel mixer, thereby obtaining a toner $A_1$.

Similarly, 0.3 parts by weight of the same fine silicic acid powder (silica) as used in the production of the toner $A_1$ was added to 100 parts by weight of the toner particle group $(b)_1$, and the mixture was agitated in the Henschel mixer, thereby obtaining a toner B1.

After this, the toners A1 and B1 were mixed together in the Henschel mixer to obtain a toner having a number average particle size of approximately 7 μm.

The mixing condition (load) for the mixing together of the toners A1 and B1, however, was milder than those for the mixing of the toner particle groups a1 and b1 with the additive.

By using the toner thus obtained as a one-component-type developer, 100,000 images were formed by the copying machine NP 6650 (manufactured by Canon K.K.) having the development device shown in FIG. 4, in an environment of 15° C./10%Rh and under the development conditions given below. In the images thus formed, the toner triboelectric charge was uniform and stable, and the image density was 1.4 in the initial stage and 1.3 after the durability test. Further, the image quality of copies of these images proved stable and excellent, involving no fogging. Furthermore, the contamination of the interior and exterior of the development device due to scattering of toner was small. The image density and fogging were evaluated as shown below:

Development Conditions

* Gap between the development sleeve and the photosensitive drum: 250 μm
* Thickness of the toner layer on the development sleeve: 200 μm
* Electrostatic latent image on the photosensitive drum: +600 V in the dark portions and 0 V in the light portions
* DC voltage of bias: +150 V
* Alternating voltage of bias: one exhibiting a peak-to-peak voltage of 1400 V and a rectangular waveform of a frequency of 1800 Hz Image density Measurement was performed at ten points by using a Macbeth reflection densitometer, and the average of the measured values was regarded as the image density.

Evaluation of fogging

Generation of fogging was visually evaluated from the images obtained.

EXAMPLE 2

A black fine powder was prepared by using the same composition and the same process as those in Example 1, and divided into toner particle groups a2 and b2 having different average particle sizes. Then, 0.6 parts by weight of fine silicic acid powder (silica) and, further, 0.5 parts by weight of cerium oxide were added to 100 parts by weight of the toner particle group a2 having a smaller particle size, and the mixture was agitated in a Henschel mixer, whereby a toner A2 was obtained.

Further, 0.3 parts by weight of the same kind of silica as used in the production of the toner A2 was added to 100 parts by weight of the toner particle group (b)2 having a larger particle size, and the mixture was likewise agitated in the Henschel mixer, whereby a toner B2 was obtained.

After this, the toners A2 and B2 were mixed together in the Henschel mixer to obtain a toner having a number average particle size of approximately 7 μm.

The mixing condition (load) for the mixing together of the toners A2 and B2, was milder than those for the mixing of the toner particle groups a2 and b2 with the additives.

By using the toner thus obtained, 100,000 images were formed in the same manner as in Example 1. In the images thus formed, the image density was high even after the durability test as in Example 1, and the toner triboelectric charge was uniform and stable. Further, the image quality of copies of these images proved stable and excellent, involving no fogging. Furthermore, the contamination of the interior and exterior of the development device due to scattering of toner was small, and the durability of the cleaning means (the cleaning blade) for the photosensitive member had been markedly improved.

EXAMPLE 3

The following materials were mixed together, and then melted and kneaded in a roll mill at 160° C.:

| | |
|---|---|
| * styrene-2-ethylhexylacrylate-divinylbenzene copolymer | 100 parts by weight |
| * nigrosine | 5 parts by weight |
| * a magnetite having a BET specific surface area of 8 $m^2/g$ | 50 parts by weight |

The molten and kneaded substance thus obtained was roughly pulverized by a hammer mill, and further, finely pulverized by a jet pulverizer. Then, it was classified by using an air classifier to obtain a black toner particle group (b)3 having a number average particle size of approximately 8 μm.

A toner particle group (a)3 was prepared in the same way as the toner particle group (b)3 except that the amount of nigrosine was 3 parts and that of the magnetite was 70 parts.

Then, 0.6 parts by weight of fine silicic acid powder (silica) was added to 100 parts by weight of the toner particle group (a)3, and the mixture was agitated in a Henschel mixer, whereby a toner A3 was obtained.

Further, 0.3 parts by weight of the same kind of silica as used in the toner A3 was added to 100 parts by weight of the toner particle group (b)3 and the mixture was agitated in the Henschel mixer, whereby a toner B3 was obtained.

After this, the toners A3 and B3 were mixed together in the Henschel mixer to obtain a toner having a number average particle size of approximately 7 μm.

The mixing condition (load) for the mixing together of the toners A3 and B3 was milder than those for the mixing of the toner particle groups a3 and b3 with the additive. By using the toner thus obtained, images were formed in the same manner as in Example 1. In the images thus formed, the image density was 1.4 in the initial stage and 1.35 after the durability test, and the toner triboelectric charge was uniform and stable. Further, the image quality of copies of these images proved stable and excellent, involving no fogging. Furthermore, the contamination of the interior and exterior of the development device due to scattering of toner was small.

EXAMPLE 4

The following materials were mixed together, and then melted and kneaded in a roll mill at 160° C.:

| | |
|---|---|
| * styrene-2-ethylhexylacrylate-divinylbenzene copolymer | 100 parts by weight |
| * nigrosine | 5 parts by weight |
| * a magnetite having a BET specific surface area of 8 $m^2/g$ | 50 parts by weight |

The molten and kneaded substance thus obtained was roughly pulverized by a hammer mill, and further, finely pulverized by a jet pulverizer. Then, it was classified by using an air classifier to obtain a black toner particle group (b)4 having a number average particle size of approximately 8 μm.

0.3 parts by weight of fine silicic acid powder (silica) was added to 100 parts by weight of the toner particle group (b)3, and the mixture was agitated in a Henschel mixer, whereby a toner B4 was obtained.

Then, a toner particle group (a)4 having the same composition as the toner particle group (b)4 and having a substantially spherical configuration was prepared in the same way as the toner particle group (b)4 except that the amount of nigrosine was 3 parts and the amount of the magnetite was 70 parts and that suspension polymerization was utilized. Then, 0.6 parts by weight of the same fine silicic acid powder (silica) as used in the toner B4 was added to 100 parts by weight of the toner particle group (a)4, as in the case of the toner B4, and the mixture was agitated in the Henschel mixer, whereby a toner A4 was obtained.

After this, the toners A4 and B4 were mixed together in the Henschel mixer to obtain a toner having a number average particle size of approximately 7 μm.

The mixing condition (load) for the mixing together of the toners A4 and B4 was milder than those for the mixing of the toner particle groups a4 and b4 with the additive.

By using the toner thus obtained, images were formed in the same manner as in Example 1. In the images thus formed, the image density was high, and the toner triboelectric charge was uniform and stable. Further, the image quality of copies of these images proved stable and excellent. Furthermore, the contamination of the interior and exterior of the development device due to scattering of toner was small.

EXAMPLE 5

The following materials were mixed together, and then melted and kneaded in a roll mill at 160° C.:

| | |
|---|---|
| * styrene-2-ethylhexylacrylate-divinylbenzene copolymer | 100 parts by weight |
| * nigrosine | 5 parts by weight |
| * a magnetite having a BET specific surface area of 8 $m^2/g$ | 50 parts by weight |

The molten and kneaded substance thus obtained was cooled, and then roughly pulverized by a hammer mill, and further, finely pulverized by a jet pulverizer. Then, it was classified by using an air classifier to obtain a black toner particle group having a number average particle size of approximately 7 μm.

Then, the black fine particle toner thus obtained was fed into the air classifier again so as to be classified into a toner particle group (a)5 having a number average particle size of approximately 5 μm and a toner particle group (b)5 having a number average particle size of approximately 8 μm. Then, 0.6 parts by weight of fine silicic acid powder (silica) was added to 100 parts by weight of the toner particle group (a)5, and the mixture was agitated in a Henschel mixer, whereby a toner A5 was obtained.

0.3 parts by weight of titanium oxide particles was added to 100 parts by weight of the toner particle group (b)5, and the mixture was agitated in the Henschel mixer, whereby a toner B5 was obtained.

After this, the toners A5 and B5 were mixed together in the Henschel mixer to obtain a toner having a number average particle size of approximately 7 μm.

The mixing condition (load) for the mixing together of the toners A5 and B5 was milder than those for the mixing of the toner particle groups a5 and b5 with the additives.

By using the toner thus obtained, images were formed in the same manner as in Example 1. In the images thus formed, the toner triboelectric charge was uniform and stable, and the image density was high, and, further, the image quality of the copies of these images proved stable and excellent. Furthermore, the contamination of the interior and exterior of the development device due to scattering of toner was small.

EXAMPLE 6

The following ingredients were heated at 70° C. in a container, and melted or dispersed to prepare a monomer composition:

| | |
|---|---|
| * styrene | 185 parts by weight |
| * trifluoroethyl acrylate | 15 parts by weight |
| * cyclized rubber, Albex CK-450 (manufactured by Hoechst Japan) | 10 parts by weight |
| * Cyanine Blue 4920 (manufactured by Dainichiseika) | 20 parts by weight |
| * Parafin Wax T-550 (manufactured by Nippon Seiro) | 32 parts by weight |
| * initiator V-601 (manufactured by Wako Pure Chemical Industries) | 10 parts by weight |

Apart from the above, 10 g of aminoalkyl denatured coloidal silica was added to 1200 ml of ion exchange water, and adjusted to pH=6 by HCl. Further, 1 g of $Na_2O_3$ was added thereto and the mixture was heated to 70° C. Then, it was subjected to dispersion for 15 minutes at a speed of 1000 rpm by using the TK Homomixer Type M (manufactured by Tokushu Kika Kogyo).

Further, 1.1 g of $Al_2(SO_4)_3$ was added thereto and dispersed for 15 minutes at a speed of 10000 rpm to prepare a dispersion medium.

The above monomer composition was added to the dispersion medium thus obtained, and the mixture was agitated for 60 minutes in a nitrogen atmosphere at a speed of 10000 rpm and at a temperature of 70° C. to granulate the monomer composition.

After this, polymerization was effected for 10 minutes at 70° C. while agitating with a paddle mixing blade.

After the completion of the polymerization, the reaction product was cooled, and NaOH was added thereto to dissolve the dispersion agent. Then, it was filtered, washed in water, and dried, whereby a toner particle group (a)6 having a number average particle size of approximately 5 μm was obtained.

Then, the above process was repeated except that the agitating conditions were changed, thereby preparing a toner particle group (b)6 having a number average particle size of approximately 8 μm.

Next, 0.3 parts by weight of fine silicic acid (silica) powder and 0.5 parts by weight of strontium titanate as cleaning assistant were added to 100 parts by weight of the toner particle group (a)6 thus obtained, and the mixture was agitated in a Henschel mixer to obtain a toner A6.

Similarly, 0.3 parts by weight of the same type of silica as used for the toner A6 was added to 100 parts by weight of the toner particle group (b)6, and the materials were mixed and agitated together in the Henschel mixer to obtain a toner B6.

After this, the toners A6 and B6 were mixed together in the Henschel mixer to obtain a toner having a number average particle size of approximately 7 μm.

The mixing condition (load) for the mixing together of the toners A6 and B6 was milder than those for the mixing of the toner particle groups a6 and b6 with the additives.

By using the toner thus obtained, images were formed in the same manner as in Example 1. In the images thus formed, the toner triboelectric charge was uniform and stable, and the image density was high, and, further, the image quality of copies of these images proved stable and excellent. Furthermore, the contamination of the interior and exterior of the development device due to scattering of toner was small. Further, the toner proved also effective in terms of the cleaning of the photosensitive member surface.

Comparative Example 1

0.4 parts by weight of the fine powder of silicic acid used in Example 1 was added to 100 parts by weight of the black fine powder having a number average particle size of approximately 7 μm, obtained in Example 1, and the materials were mixed together in a Henschel mixer to obtain a toner.

By using the toner thus obtained, image formation was performed in the same way as in Example 1. The tribo electric charge of the toner was somewhat changed after durability test, and the image density, which was 1.4 in the initial stage, was 1.2 after durability test. Further, some fog was to be observed in the images obtained after durability test.

EXAMPLE 7

A toner was obtained in the same manner as in Example 1 except that the mixing together of the toners A1 and B1 was performed under the same condition (load) as the mixing of the toner particle groups a1 and b1 with the additive.

By using the toner thus obtained, image formation was conducted in the same manner as in Example 1. In the images thus formed, the toner triboelectric charge was substantially uniform, and the image density was 1.35 at the initial stage and 1.25 after durability test. The image quality of copies obtained with this toner proved stable and excellent, involving no fogging. Furthermore, the contamination of the interior and exterior of the development device due to scattering of toner was small.

While the present invention has been described with respect to what is presently considered to be the preferred embodiments, it is to be understood that the invention is not limited to the disclosed embodiments. The present invention is intended to cover various modifications and equivalent formulations included within the spirit and scope of the appended claims. The scope of the following claims is to be accorded the broadest interpretation so as to encompass all such modifications and equivalent formulations.

What is claimed is:

1. A toner for electrophotography comprising:

a first toner A comprising a toner particle group (a) having a first particle size distribution and an external additive; and a second toner B comprising a toner particle group (b) having a second particle size distribution different from said first particle size distribution and an external additive;

wherein said toner particle group (a) has a smaller average particle size than that of said toner particle group (b) and the amount of said external additive in said first toner A is greater than the amount of said external additive in said second toner B, and said external additive comprises at least one kind of fine particles selected from the group consisting of silica, titanium oxide, molybdenum disulfide, tungsten disulfide, boron nitride, lead oxide, antimony oxide, strontium sulfate, aluminum sulfate, calcium carbonate, strontium titanate, cerium oxide, strontium oxide, a metallic salt of a higher fatty acid, graphite, barium fluoride, calcium fluoride, carbon fluoride, carbon black, conductive tin oxide, styrene homopolymer powder, substituted styrene homopolymer powder, styrene copolymer powder, polymethyl methacrylate powder, polybutyl methacrylate powder, polyvinyl chloride powder, polyvinyl acetate powder, polyethylene powder, polypropylene powder, polyester powder, polyurethane powder, polyamide powder, epoxy resin powder, polyvinyl butyral powder, polyacrylic resin powder, rosin powder, denatured rosin powder, terpene resin powder, phenol resin powder, aliphatic hydrocarbon resin powder, alicyclic hydrocarbon resin powder, aromatic petroleum resin powder, chlorinated paraffin powder, paraffin wax powder, polytetrafluoroethylene powder and polyvinylidene fluoride powder.

2. A toner according to claim 1, wherein said toner particle group (a) and (b) are obtained by classifying a toner particle group having a specific particle size distribution into said toner particle group (a) having a small average particle size and said toner particle group (b) having a large average particle size.

3. A toner according to claim 1, wherein said toner particle groups (a) and (b) are separately prepared.

4. A toner according to claim 1, wherein said toner particle group (a) has a number average particle size of 2 to 8 μm, said toner particle group (b) has a number average particle size of 5 to 12 μm, and said toner has a number average particle size of 2 to 12 μm.

5. A toner according to claim 4, wherein said toner particle group (a) has a number average particle size of 3 to 7 μm, said toner particle group (b) has a number average particle size of 6 to 9 μm, and said toner has a number average particle size of 3 to 9 μm.

6. A toner according to claim 1, wherein the load at which said toners A and B are mixed together is smaller than the load at which said toner particle groups (a) and (b) are mixed with the external additive, respectively.

7. The toner according to claim 1, wherein said substituted styrene homopolymer powder is selected from the group consisting of poly-p-chlorostyrene powder and polyvinyl toluene powder.

8. The toner according to claim 1, wherein said styrene copolymer powder is selected from the group consisting of styrene-p-chlorostyrene copolymer powder, styrene-vinyltoluene copolymer powder, styrenevinylnapthalene copolymer powder, styrene-methyl-acrylate copolymer powder, styrene-ethyl-acrylate copolymer powder, styrene-butylacrylate copolymer powder, styrene-acryl-2-ethylhexyl copolymer powder, styrene-octyl-acrylate copolymer powder, styrene-methyl-methacrylate copolymer powder, styrene-ethyl-methacrylate copolymer powder, styrene-butylmethacrylate copolymer powder, styrene-α-methylchloromethacrylate copolymer powder, styrene-acrylonitrile copolymer powder, styrene-vinyl-methyl-ether copolymer powder, styrene-vinyl-methyl-ketone copolymer powder, styrene-butadiene copolymer powder, styrene-isoprene copolymer powder, styrene-actylonitrile-indene copolymer powder, styrene-maleic-acid copolymer powder, and styrene-maleate copolymer powder.

9. The toner according to claim 1, wherein said metallic salt of a higher fatty acid is zinc stearate.

* * * * *